US009903095B2

(12) United States Patent
Parker

(10) Patent No.: US 9,903,095 B2
(45) Date of Patent: Feb. 27, 2018

(54) TOOL COUPLER

(71) Applicant: Caterpillar Inc., Peoria, IL (US)

(72) Inventor: Jeffrey Michael Parker, Fuquay Varina, NC (US)

(73) Assignee: Caterpillar Inc., Peoria, IL (US)

( * ) Notice: Subject to any disclaimer, the term of this patent is extended or adjusted under 35 U.S.C. 154(b) by 373 days.

(21) Appl. No.: 14/610,606

(22) Filed: Jan. 30, 2015

(65) Prior Publication Data

US 2016/0222622 A1 Aug. 4, 2016

(51) Int. Cl.

| | |
|---|---|
| ***E02F 3/36*** | (2006.01) |
| ***E02F 3/627*** | (2006.01) |
| ***E02F 9/22*** | (2006.01) |

(52) U.S. Cl.

CPC ..... *E02F 3/627* (2013.01); *E02F 3/364* (2013.01); *E02F 3/3622* (2013.01); *E02F 3/3627* (2013.01); *E02F 3/3663* (2013.01); *E02F 9/2271* (2013.01)

(58) Field of Classification Search

CPC ..... E02F 3/627; E02F 3/3627; E02F 3/3663; E02F 3/3622; E02F 3/364; E02F 9/2271

USPC ..... 414/685, 686, 820

See application file for complete search history.

(56) References Cited

U.S. PATENT DOCUMENTS 3,077,999 A * 2/1963 Svoboda ..... E02F 3/4133 37/409
3,815,687 A * 6/1974 Federspiel ..... E02F 3/627 172/272
3,907,333 A 9/1975 Gianessi et al.
3,982,643 A * 9/1976 MacGregor ..... E02F 3/968 172/273
4,051,962 A * 10/1977 Westendorf ..... E02F 3/968 172/275
4,247,242 A * 1/1981 Goertzen ..... A01D 87/0069 280/460.1
4,798,511 A * 1/1989 Kaczmarczyk ..... E02F 3/36 248/52
5,135,347 A * 8/1992 Kaczmarczyk ..... A01B 59/048 172/274

(Continued)

FOREIGN PATENT DOCUMENTS

| | | |
|---|---|---|
| EP | 1528164 | 5/2005 |
| WO | WO 2012/061895 | 5/2012 |
| WO | WO 2012/156672 | 11/2012 |

*Primary Examiner* — Joshua J Michener
*Assistant Examiner* — Kyle J. Walraed-Sullivan
(74) *Attorney, Agent, or Firm* — Finnegan, Henderson, Farabow, Garrett & Dunner, LLP

(57) ABSTRACT

A tool coupler is disclosed for coupling a tool system to a machine. The tool coupler may including a base configured to connect to the tool system and having spaced-apart plates, hooks, a first pin, and at least one web connecting the spaced-apart plates. The tool coupler may also include an anchor configured to connect to the machine and having a monolithic structure. The anchor may also include a rounded primary engagement feature protruding outward to engage the hooks, a transverse slot formed within a top surface of the monolithic structure and configured to receive the first pin, and an elongated pocket formed inside the monolithic structure that is open to the transverse slot. The anchor may further include a wedge, and a linear actuator disposed inside the pocket and connected to push the wedge into the transverse slot over the first pin.

5 Claims, 2 Drawing Sheets

(56) References Cited

U.S. PATENT DOCUMENTS 5,141,385 A * 8/1992 Tibbatts ..... E02F 3/3622 172/275
5,224,816 A * 7/1993 Kaczmarczyk ..... E02F 3/3622 172/275
5,456,030 A * 10/1995 Barone ..... E02F 3/3618 172/272
6,139,212 A * 10/2000 Heiple ..... E02F 3/3618 37/398
6,142,724 A * 11/2000 Hirooka ..... E02F 3/6273 414/686
6,691,438 B2 * 2/2004 Fatemi ..... E02F 3/3627 37/403
6,709,224 B2 * 3/2004 Heiple ..... E02F 3/3627 37/468
6,718,663 B1 * 4/2004 Geraghty ..... E02F 3/3618 37/443
6,994,511 B2 2/2006 Westendorf et al.
7,014,411 B2 * 3/2006 Westendorf ..... E02F 3/6273 172/275
7,431,553 B2 * 10/2008 Nishi ..... E02F 3/34 172/274
7,509,758 B2 * 3/2009 Nesseth ..... E02F 3/3668 172/272
8,287,226 B1 * 10/2012 Westendorf ..... E02F 3/369 172/274
8,500,386 B2 * 8/2013 Griffiths ..... E02F 3/627 414/686
8,684,656 B2 * 4/2014 Hilsden ..... E02F 3/627 172/272
9,057,179 B1 * 6/2015 Kubas ..... E02F 3/627
9,169,614 B2 * 10/2015 Miller ..... E02F 3/962
2002/0071754 A1 * 6/2002 Fatemi ..... E02F 3/3618 414/723
2004/0218971 A1 * 11/2004 Lim ..... E02F 3/3618 403/322.3
2005/0232742 A1 * 10/2005 Wimmer ..... E02F 3/3627 414/723
2007/0201973 A1 * 8/2007 McDermott ..... E02F 3/3631 414/723
2007/0292254 A1 * 12/2007 Mailleux ..... E02F 3/6273 414/686
2008/0067784 A1 * 3/2008 Calvert ..... E02F 3/3622 280/507
2008/0296031 A1 * 12/2008 Yeager ..... E02F 3/364 172/272
2009/0255151 A1 * 10/2009 Wimmer ..... E02F 3/3627 37/468
2010/0232920 A1 * 9/2010 Calvert ..... E02F 3/3627 414/723
2012/0027551 A1 2/2012 Rohou
2012/0237283 A1 * 9/2012 Stollery ..... E02F 3/3631 403/31
2014/0030005 A1 * 1/2014 Friedrich ..... E02F 3/365 403/31
2014/0294497 A1 * 10/2014 Robl ..... E02F 3/3622 403/376
2014/0301771 A1 * 10/2014 Hiragakiuchi ..... E02F 3/627 403/119
2014/0356059 A1 * 12/2014 Friedrich ..... E02F 3/3618 403/316
2014/0373401 A1 * 12/2014 Friedrich ..... E02F 3/3663 37/468
2015/0068073 A1 * 3/2015 Martin ..... E02F 3/3631 37/195
2015/0225920 A1 * 8/2015 Friedrich ..... E02F 3/3618 403/31
2015/0376861 A1 * 12/2015 Dahlquist ..... E02F 3/3622 403/345

* cited by examiner

TOOL COUPLER

TECHNICAL FIELD

The present disclosure relates generally to a tool coupler and, more particularly, to a coupler for removably connecting a tool system to a mobile machine.

BACKGROUND

A typical worksite requires machines to perform a variety of different functions, including digging, leveling, grading, hauling lifting, trenching, etc. These functions are most efficiently conducted with tool systems specifically designed for each of the different functions. A tool coupler can be used to increase the functionality and versatility of the machine by allowing different tool systems to be quickly and interchangeably connected to the machine.

An exemplary tool coupler is disclosed in U.S. Patent Publication No. 2012/0027551 (the '551 publication) by Rohou that published on Feb. 2, 2012. In particular, the '551 publication discloses a tool coupler for an agricultural vehicle. The tool coupler includes a bracket connected to the vehicle, and a mast arrangement connected to a front loader. The mast arrangement comprises a pin configured to be received within a hook-shaped bearing point of the bracket, and a locking element that is movable by the operator. To perform the coupling, the operator drives the vehicle toward the front loader, until the pin of the mast arrangement is placed inside the bearing point of the bracket. The operator then exits the vehicle to make a hydraulic connection, and then re-enters the vehicle. The operator uses lift cylinders of the front loader to rotate the mast arrangement about the pin until openings in the mast align with corresponding openings in the bracket. The operator again exits the cabin and moves the locking element into the aligned openings, thereby completing the coupling. The operator enters the cabin again to control the vehicle and the newly connected front loader.

While the tool coupler of the '551 publication may adequately couple a front loader to an agricultural vehicle, it may still be less than optimal. In particular, the tool coupler of the '551 application requires the operator to leave the cabin multiple times in order to properly engage the coupler. And if the holes in the bracket and mast are not properly aligned when the operator exits the cabin to move the locking element, the locking element will not be able to pass through the openings. It may be difficult using the tool coupler of the '551 publication to properly align the holes, as the operator's view of the holes may be obstructed. As a result, the operator will have to repeat the process multiple times, until the holes are properly aligned. This inconvenience could reduce efficiency, increase operating costs, and open the door to user error.

The tool coupler of the present disclosure addresses one or more of the needs set forth above and/or other problems of the prior art.

SUMMARY

One aspect of the present disclosure is directed to a base for a tool coupler. The base may include spaced-apart plates each having an upper end and a bottom end. The bottom end may have a leading edge and a trailing edge. The base may further include a female engagement feature located at the leading edge, and a male engagement feature located between the female engagement feature and the trailing edge of the spaced-apart plates.

Another aspect of the present disclosure is directed to an anchor for a tool coupler. The anchor may include a monolithic structure having an inside surface, an outside surface, a top surface, a bottom surface, a leading surface, and a trailing surface. The anchor may also include a primary engagement feature protruding outward from an intersection of the top and leading surfaces, and a secondary engagement feature formed within the top surface.

Yet another aspect of the present disclosure is directed to a tool coupler. The tool coupler may include a base configured to connect to the tool system and have spaced-apart plates each with an upper end and a bottom end, the bottom end having a leading edge and a trailing edge. The base may also have hooks located at the leading edge, and a first pin located between the hooks and the trailing edge of the spaced-apart plates. The first pin may extend transversely between the spaced-apart plates. The base may also have at least one web connecting the spaced-apart plates. The tool coupler may further include an anchor configured to connect to the machine and having a monolithic structure with an inside surface, an outside surface, a top surface, a bottom surface, a leading surface, and a trailing surface. The anchor may also have a rounded primary engagement feature protruding outward from an intersection of the top and leading surfaces to engage the hooks, a transverse slot formed within the top surface and configured to receive the first pin, and an elongated pocket formed inside the monolithic structure that is open to the transverse slot. The anchor may further have a wedge, and a linear actuator disposed inside the pocket and connected to the wedge. The linear actuator may be configured to selectively push the wedge into the transverse slot over the first pin to inhibit removal of the first pin from the transverse slot.

DETAILED DESCRIPTION

Figure 1:
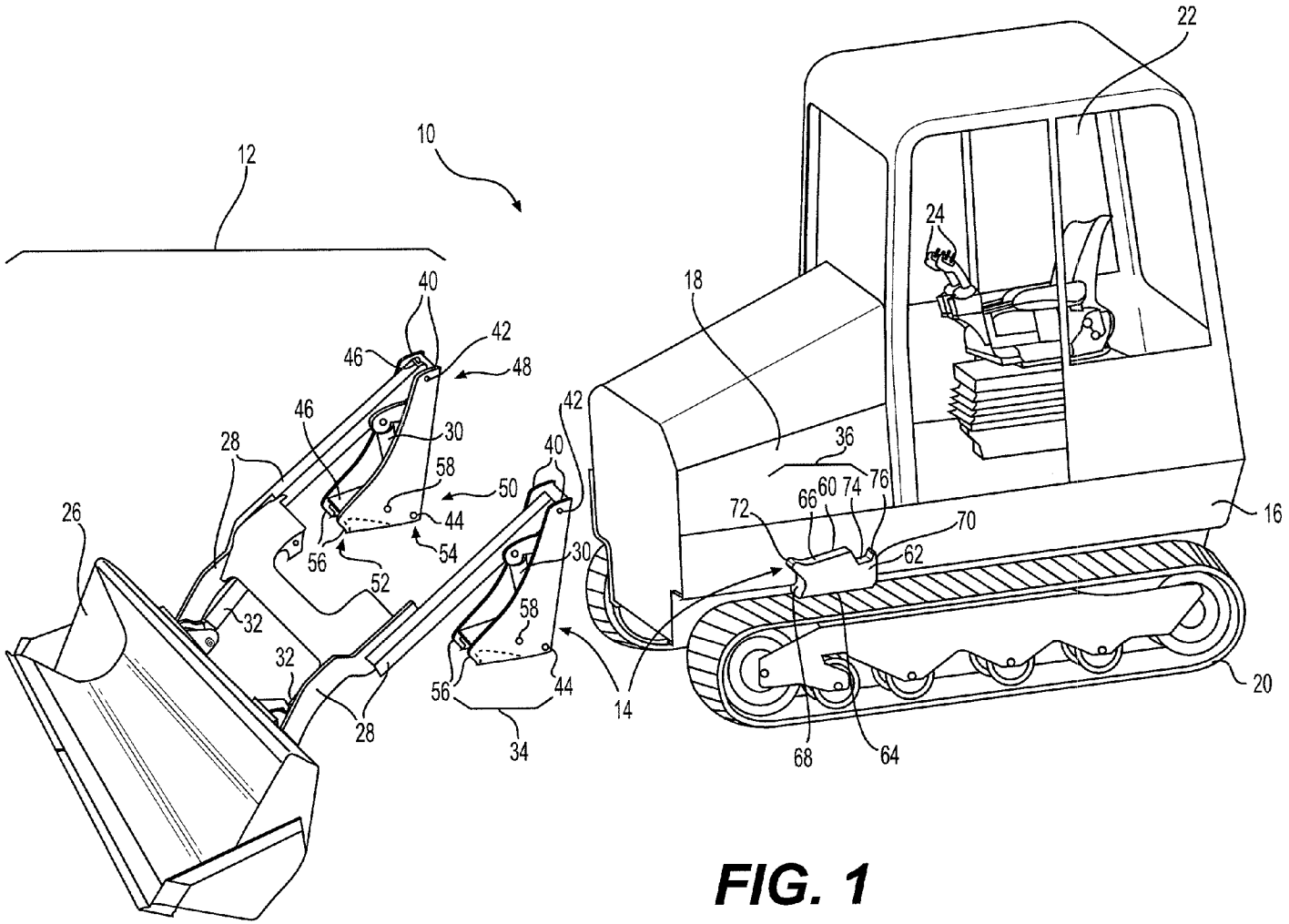
FIG. 1 is a pictorial illustration of an exemplary disclosed machine and tool system.

FIG. 1 illustrates an exemplary machine 10. Machine 10 is a mobile machine that performs some type of operation associated with an industry, such as mining, construction, farming, transportation, or any other industry known in the art. In the disclosed example, machine 10 is a general track-type-tractor capable of accepting any number of different tool systems 12 by way of a coupler 14, thereby becoming an application-specific machine. It should be noted, however, that machine 10 could be another type of machine, if desired. For example, machine 10 could be a wheeled machine and/or may have a fixed or integrated tool system in addition to tool system 12 that is removable. For example, machine 10 could be a haul truck having an integrated bed, a dozer having an integrated blade, or a backhoe having an integrated shovel. In any of these examples, machine 10 could still be configured to selectively connect with another tool system 12 by way of coupler 14, if desired.

Machine 10 includes, among other things, a frame 16, a power source (e.g., an engine) 18 mounted to frame 16, one or more traction devices 20, and an operator station 22 supported by frame 16. Operator station 22 may house any number and type of input devices 24 for use by the operator in controlling tool system 12, coupler 14, power source 18, and/or traction devices 20.

Tool system 12 includes any type of tool 26, linkage that physically supports tools 26, and one or more actuators that are connected to move the linkage and tool 26. In the disclosed embodiment, tool system 12 is a front loader, tool 26 is a loader bucket, and four different actuators are connected to lift and tilt tool 26. Specifically, the depicted tool system 12 includes parallel spaced-apart lift arms 28 that are pivotally connected to tool 26 at distal ends. One lift cylinder 30 is associated with each lift arm 28 (e.g., pivotally connected at a rod-end to a mid-portion of each lift arm 28), and two tilt cylinders 32 pivotally connect the mid-portions of lift arms 28 to tool 26. With this arrangement, extensions and retractions of lift cylinders 30 cause raising and lowering of tool system 12, while extensions and retractions of tilt cylinders 32 cause dumping and racking of tool 26. It should be noted that the disclosed tool system 12 is exemplary only, and many other types and configurations of tool system 12 may be selectively coupled to machine 10 via coupler 14.

Figure 2:
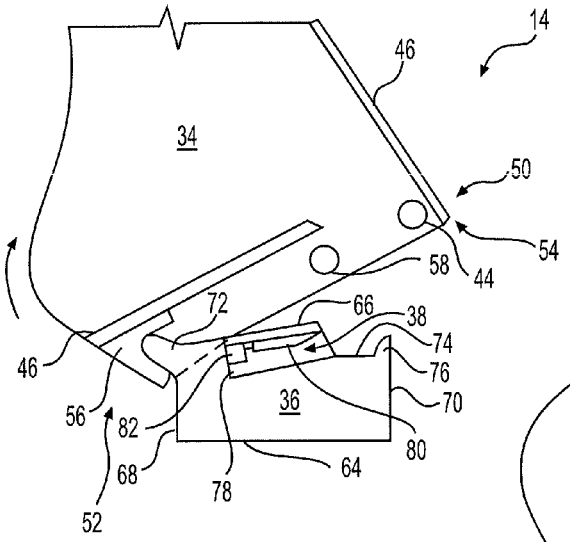
FIGS. 2-4 are cutaway view illustrations of an exemplary disclosed tool coupler that may be used to connect the tool machine of FIG. 1 with the machine of FIG. 1, each of FIGS. 2-4 showing a different operating position of the tool coupler.
Figure 3:
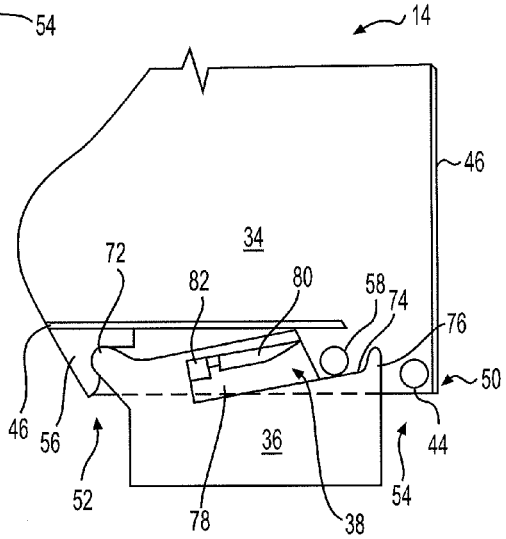
Figure 4:
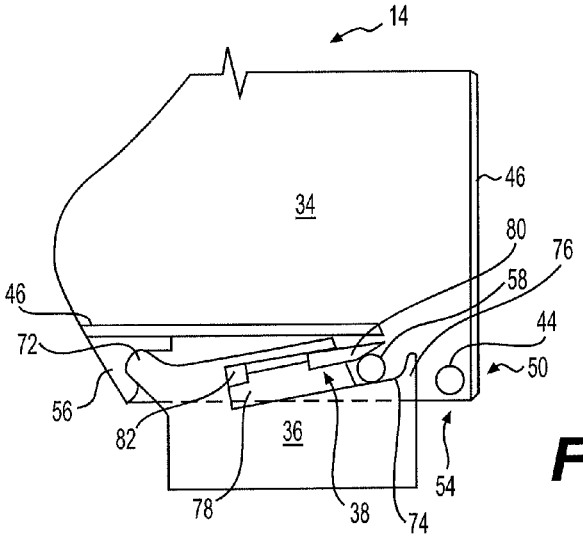

Coupler 14 is essentially comprised of three different parts, including a tool system base ("base") 34, a machine anchor ("anchor") 36, and a lock 38 (shown only in FIGS. 2-4). Base 34 is connected to tool system 12; anchor 36 is connected to machine 10; and lock 38 is used to selectively connect base 34 to anchor 36. Lock 38, as will be described in more detail below, can be selectively activated by the operator of machine 10 from inside station 22.

As shown in FIG. 1, each base 34 is fabricated primarily from two separate plates 40 that are spaced apart from each other. Plates 40 sandwich the base end of the corresponding lift arm 28, and a pin 42 passes between plates 40 and through the base end of lift arm 28. During lifting of lift arm 28, tool system 12 pivots about pin 42. Plates 40 may together also function as a housing that substantially encloses and protects lift cylinder 30. In particular, lift cylinder 30 may be disposed between plates 40, and connect at a head end to a pin 44 that also passes between plates 40. With this arrangement, reaction forces generated by lift cylinder 30 during lifting of tool system 12 are received and countered by base 34. Pins 42 and 44 may be connected to plates 40 in any manner known in the art. One or more webs 46 may interconnect plates 40 to provide structural integrity to base 34.

Base 34 has an upper end 48 that receives pin 42, and a bottom end 50 that receives pin 44. Bottom end 50 is larger than upper end 48, and includes features intended to mate with corresponding features in anchor 36. For example, bottom end 50 may extend forward toward tool 26 more than upper end 48, such that a length of bottom end 50 in the fore/aft direction is about three to five-times greater than the same dimension of upper end 48.

Bottom end 50 of base 34 has a leading edge (i.e., an edge facing tool 26) 52 and a trailing edge 54 located opposite each other in the fore/aft direction. As shown in FIGS. 2-4, one or more primary engagement features ("primary features") 56 are located at leading edge 52. In the disclosed example, primary features 56 are female features (e.g., identical hooks) formed within or otherwise connected to (e.g., welded to an inside surface of) each of plates 40, these hooks together being configured to engage a corresponding male feature of anchor 36. In another example, primary features 56 may additionally or alternatively include a pin that passes transversely between plates 40 at the same location as where the hooks (e.g., where tips of the hooks) are shown. Other types and/or shapes of engagement features may also be possible.

One or more secondary engagement features ("secondary features") 58 are located between primary features 56 and trailing edge 54. In the disclosed embodiment, a single secondary feature 58 is included in each base 34, and shown as being located between primary features 56 and pin 44. Secondary feature 58 may be a secondary engagement feature, as it is configured to engage anchor 36 after primary features 56 have already been engaged with anchor 36. In the depicted example, secondary feature 58 is a pin that passes transversely between plates 40.

Returning to FIG. 1, anchor 36 is received between plates 40 at bottom end 50 of base 34. Anchor 36 is a monolithic structure having an inside surface 60, an outside surface 62, a bottom surface 64, a top surface 66, a leading surface 68, and a trailing surface 70. Inside and outside surfaces 60, 62 are generally planar, oriented generally orthogonal to a ground surface under machine 10, aligned in the fore-aft direction of machine 10, and mirror images of each other. Bottom surface 64 is generally perpendicular to inside and outside surfaces 60, 62, and parallel with the ground surface. Top surface 66 is generally perpendicular to inside and outside surfaces 60, 62, and tilted downward in the forward direction relative to bottom surface 64. The tilting of top surface 66 may allow for material buildup on top of anchor 36, without the buildup interfering with the coupling of base 34 to anchor 36. Leading and trailing end surfaces 68, 70 are both generally perpendicular to inside and outside surfaces 60, 62 and also to bottom surface 64.

A primary engagement feature ("primary feature") 72 (i.e., the male feature discussed above) protrudes forward and upward from an intersection of top and leading surfaces 66, 68. Primary feature 72 is rounded at a distal end that engages primary features 56, thereby creating a smooth surface about which the hooks pivot. Primary feature 72 protrudes away from leading surface 68 far enough to avoid contact of feature 56 (i.e., of the tips of the hooks) with leading surface 68. An outer radius of primary feature 72 may be about equal to or smaller than an inner radius of feature 56.

A secondary or female engagement feature ("secondary feature") 74 is formed within top surface 66 and configured to receive secondary feature 58. In the disclosed embodiment, secondary feature 74 is a recess or transverse slot, in which the pin of secondary feature 58 is seated during connection of base 34 to anchor 36. As shown in FIGS. 2-4, secondary feature 74 may have a depth that is at least as big as a diameter of the pin, and a length in the fore-aft direction that is 1.5-2.5 times the diameter of the pin. A leading side of secondary feature 74 is tilted backward and downward relative to leading and trailing surfaces 68, 70, such that, as secondary feature 58 is pressed down into secondary feature 74, base 34 is pulled rearward and further onto anchor 36. A bottom surface of secondary feature 74 is generally parallel to top surface 66 of anchor 36. The location and size of secondary feature 74 creates a lip 76 at the intersection of top and trailing surfaces 66, 70 that functions as an end stop for secondary feature 58. It is contemplated that, in some embodiments, lip 76 may be omitted (i.e., that secondary feature 74 may continue through trailing surface 70), if desired.

A pocket 78 is formed inside anchor 36 to house lock 38. Pocket 78 is elongated, generally aligned in the fore/aft direction, and open at one end to secondary feature 74. In this configuration, lock 38 (i.e., at least a portion thereof) is configured to selectively extend from pocket 78 into the open space of secondary feature 74, thereby inhibiting the pin of secondary feature 58 from inadvertently exiting the space. Pocket 78 may have any shape and size necessary to properly house lock 38. In the disclosed embodiment, pocket 78 has a generally square cross-section. In this embodiment, one or more planar side surfaces of pocket 78 function as guides for the moving elements of lock 38. For example, an upper surface of pocket 78 may function as a guide for lock 38, and be generally parallel with top surface 66 and the bottom surface of secondary feature 74. It is contemplated that holes and/or passages (not shown) may be formed within anchor 36 that allow for electrical, mechanical, and/or hydraulic communication with lock 38 while lock 38 is inside pocket 78.

Lock 38 may be any device known in the art that can be remotely activated by the operator to inhibit disengagement of secondary feature 58 from secondary feature 74. In the disclosed embodiment, lock 38 includes a mechanical wedge 80 and an actuator 82 that is connected to move wedge 80. Wedge 80 has a generally flat back that slides against the planar upper surface of pocket 78, and a tapered front that is configured to engage and secure secondary feature 58 inside secondary feature 74. Actuator 82 is a linear actuator, for example an electrical screw or hydraulic cylinder that, when actuated, causes wedge 80 to advance into the open space of secondary feature 74. In one example, wedge 80 is spring-biased to retract back into pocket 78 when actuator 82 is deactivated. In another example, wedge 80 is powered back into pocket 78 by actuator 82.

FIGS. 2-4 depict different stages of a coupling operation. FIGS. 2-4 will be discussed in more detail in the following section to further illustrate the disclosed concepts.

INDUSTRIAL APPLICABILITY

The presently disclosed tool coupler is applicable to any mobile machine to increase the functionality of the machine. For example, a general-use machine may utilize the disclosed coupler to selectively connect a front loader, a backhoe, a trencher, a crane, or another tool system to the machine, such that the machine can be used for many different purposes. In another example, a specific-use machine may utilize the disclosed coupler to connect with a tool system different from the one already connected to the machine. This increase in functionality lowers capital costs for the machine owner, and/or allows for increased business opportunities. Operation of coupler 14 will now be described in detail with respect to FIGS. 2-4.

As shown in FIG. 2, the first step in connecting tool system 12 to machine 10 is to drive machine 10 forward toward tool system 12, until primary feature 72 is received within feature 56 (i.e., until the male protrusion of anchor 36 rests within the hooks of base 34). Base 34 naturally tilts forward as shown in FIG. 2 when tool system 12 is resting on the ground surface and not connected to machine 10, due to the kinematics of tool system 12. Accordingly, during the forward movement of machine 10 described above, the operator is able to observe the engagement of features 72 and 56, and to selectively adjust the trajectory of machine 10 so that features 72, 56 align and engage properly.

After engagement of primary feature 72 with primary features 56, the operator connects hydraulic supply lines (not shown) located onboard machine 10 with corresponding lines of tool system 12. It should be noted that each tool system 12 attachable to machine 10 may have different fluid supply needs and, accordingly, different connection requirements. For example, some tool systems 12 may need a single hose connection to be made, while other tool systems 12 may require multiple hoses to be connected. It is also possible, that some tool systems 12 may not require any fluid connections.

In the disclosed embodiment, at least two supply and two drain connections must be made (i.e., one supply and one drain for each set of lift and tilt cylinders 30, 32). In this example, these connections are made manually by the operator of machine 10. In some applications, the manual connections may require the operator to exit station 22. In other applications, however, the operator may be able to reach the corresponding hoses and perform the required connections while remaining in station 22. In yet other embodiments, the connections may be made automatically during the mechanical coupling of base 34 with anchor 36.

Once the appropriate hydraulic connections are made, the operator manipulates one or more input devices 24 inside station 22 to cause a pivoting motion of base 34 about primary feature 72. For example, the operator may cause lift cylinders 30 to retract, such that base 34 (when viewed from the perspective of FIG. 1) rotates in a clockwise direction. At this point in time, wedge 80 is fully retracted into pocket 78. The operator causes pivoting of base 34 in this direction until secondary feature 58 is placed within secondary feature 74 (shown in FIG. 3).

Once the operator visually confirms that secondary feature 58 is properly located inside secondary feature 74, and without having to exit station 22, the operator locks secondary feature 58 in place. In particular, as shown in FIG. 4, the operator causes actuator 82 to force wedge 80 out of pocket 78 and over the top of secondary feature 58. The operator initiates this operation via manipulation of input device 24. As the tapered surface of wedge 80 engages secondary feature 58, the tapered surface functions to force secondary feature 58 further into secondary feature 74. Once wedge 80 is fully extended, coupling of tool system 12 to machine 10 is complete. To decouple tool system 12 from machine 10, the operator performs the above-described operations in a reverse order.

Several advantages are associated with the disclosed tool coupler. In particular, the operator is required to exit station 22 a reduced number of times (if at all) to complete the coupling. In addition, the location and configuration of anchor 36 allows clear view to the operator of the disclosed coupling process.

It will be apparent to those skilled in the art that various modifications and variations can be made to the tool coupler of the present disclosure without departing from the scope of the disclosure. Other embodiments will be apparent to those skilled in the art from consideration of the specification and practice of the tool coupler disclosed herein. For example, although machine 10 is shown as having only a single set of couplers 14 located at one end of machine 10, it is contemplated that multiple sets may be used and located at opposing ends such that two or more tool systems 12 may be simultaneously connected to machine 10. It is intended that the specification and examples be considered as exemplary only, with a true scope of the disclosure being indicated by the following claims and their equivalent.

What is claimed is:

1. An anchor for a tool coupler, comprising:

a monolithic structure having an inside surface, an outside surface, a top surface, a bottom surface, a leading surface, and a trailing surface;

a primary engagement feature protruding outward from an intersection of the top and leading surfaces;

a secondary engagement feature formed within the top surface, wherein the secondary engagement feature is a transverse slot;

an elongated pocket formed inside the monolithic structure that is open to the transverse slot; and a lock disposed inside the elongated pocket, wherein the lock includes:

a linear actuator; and a wedge connected to the linear actuator.

2. The anchor of claim 1, wherein the linear actuator is configured to selectively push the wedge into the transverse slot.

3. A tool coupler for coupling a tool system to a machine, the tool coupler comprising:

a base configured to connect to the tool system and including:

spaced-apart plates each having an upper end and a bottom end, the bottom end having a leading edge and a trailing edge;

hooks located at the leading edge;

a first pin located between the hooks and the trailing edge of the spaced-apart plates, the first pin extending transversely between the spaced-apart plates; and at least one web connecting the spaced-apart plates; and an anchor configured to connect to the machine and including:

a monolithic structure having an inside surface, an outside surface, a top surface, a bottom surface, a leading surface, and a trailing surface;

a rounded primary engagement feature protruding outward from an intersection of the top and leading surfaces to engage the hooks;

a transverse slot formed within the top surface and configured to receive the first pin;

an elongated pocket formed inside the monolithic structure that is open to the transverse slot;

a wedge; and a linear actuator disposed inside the elongated pocket and connected to the wedge, the linear actuator configured to selectively push the wedge into the transverse slot over the first pin to inhibit removal of the first pin from the transverse slot.

4. The tool coupler of claim 3, wherein the transverse slot has a leading side that is configured to urge the base further onto the anchor as the first pin is forced into the transverse slot.

5. The tool coupler of claim 3, wherein the base is configured to provide a housing and a mounting for a cylinder and a lift arm of the tool system.

* * * * *